US007168493B2

(12) United States Patent
Eddison

(10) Patent No.: US 7,168,493 B2
(45) **Date of Patent: *Jan. 30, 2007**

(54) DOWNHOLE TOOL

(75) Inventor: Alan Martyn Eddison, Stonehaven (GB)

(73) Assignee: Andergauge Limited, Aberdeen (GB)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 246 days.

(21) Appl. No.: 10/471,982

(22) PCT Filed: Mar. 15, 2002

(86) PCT No.: PCT/GB02/01207

§ 371 (c)(1),
(2), (4) Date: Feb. 12, 2004

(87) PCT Pub. No.: WO02/075104

PCT Pub. Date: Sep. 26, 2002

(65) Prior Publication Data

US 2004/0129423 A1 Jul. 8, 2004

(30) Foreign Application Priority Data

Mar. 15, 2001 (GB) ..... 0106538.2

(51) Int. Cl.
*E21B 34/14* (2006.01)

(52) U.S. Cl. ..... 166/334.4; 166/386

(58) Field of Classification Search ..... 166/323, 166/386, 334.4

See application file for complete search history.

(56) References Cited

U.S. PATENT DOCUMENTS

| | | | |
|---|---|---|---|
| 4,736,798 A | 4/1988 | Zunkel | |
| 5,101,904 A | 4/1992 | Gilbert | |
| 6,196,319 B1 | 3/2001 | Henskens et al. | |
| 6,725,937 B1 * | 4/2004 | McHardy | 166/373 |

OTHER PUBLICATIONS

International Search Report for PCT/GB02/01207 Completed Sep. 5, 2002.

* cited by examiner

*Primary Examiner*—William Neuder
(74) *Attorney, Agent, or Firm*—Alston & Bird LLP

(57) ABSTRACT

A hydraulic tool assembly for a downhole tool comprises a body (12), first and second members (14, 16) mounted for independent movement with respect to the body, and first and second control fluid chambers (24, 26) associated with the respective first and second members. Movement of the first member (14) between a first position and a second position in response to an applied force displaces control fluid from the first chamber (24) into the second chamber (26), to move the second member from a first position towards a second position to execute a tool function.

25 Claims, 2 Drawing Sheets

DOWNHOLE TOOL

FIELD OF THE INVENTION

The present invention relates to a downhole tool. In particular, but not exclusively, the present invention relates to a tool which may be utilised to control activation or actuation of another tool, device or the like. One embodiment of the invention relates to a circulating tool and a method of circulating fluid in a borehole.

BACKGROUND OF THE INVENTION

When drilling oil and gas wells, drill cuttings are produced which must be carried out of the well to surface. This is achieved by entraining the drill cuttings in drilling fluid pumped from surface down a drill string, through a drill bit and returned to surface through the annulus defined between the drill string and the borehole wall.

However, it is often found that in particular during the drilling of deviated or extended reach wells, the flow rate of the fluid returning through the annulus to surface is not sufficient to maintain entrainment of all of the drill cuttings and cuttings may settle in the borehole, restricting well access and increasing the likelihood of other problems, such as differential sticking.

Accordingly, circulating tools have been developed for circulating fluid to facilitate inter alia removal of cuttings. This has been achieved by providing a circulating tool which allows flow of a circulating fluid, typically drilling mud, directly from a string carrying the tool, through flow ports in the tool and into the annulus. This ensures a relatively high flow rate of the drilling mud in the annulus at and above the tool location.

Circulating tools also have further uses. For example, during drilling, some or all of the drilling fluid passing up the annulus can be lost into porous formations, known as loss zones. Such formations may be treated with lost-circulation material (LCM), to prevent or limit further losses. Typically, the LCM is added to the drilling fluid, which is then passed into the annulus via a circulating tool, to plug the formation.

Also, in certain situations, it may be desirable to change the properties of the drilling fluid in the bore—for example, when drilling into high pressure formations, it may be desired to inject relatively high density conditioning mud into a bore. Of course, this requires the existing volume of drilling fluid in the drill string to be circulated to surface. A circulating tool allows circulation of the drilling fluid at a higher flow rate than when, for example, in conventional fluid circulation, fluid is passed through a drilling motor and jetting ports before passing into the annulus and being circulated to surface. Therefore, the circulating tool allows the drilling fluid to be circulated to surface in a shorter time.

One known form of circulation tool includes a body with a flow port which is normally closed by a sleeve, the sleeve also defining a bore-restricting profile. When it is desired to move the sleeve to open the flow port, a plastics ball is inserted into the string at surface and pumped down the string to engage the sleeve profile. This closes the string through bore and the increased fluid pressure above the ball moves the sleeve downwards and opens the flow port.

When it is desired to close the flow port and re-open flow through the tool to the drill bit, a smaller diameter metal ball is pumped down the string, which metal ball closes the flow port and allows elevated fluid pressure above the plastics ball to squeeze the deformable ball through the profile. The metal ball is sufficiently small so as to not to engage the profile, and both balls are then caught by a ball catcher provided below the profile.

Such tools are often unreliable and require components to be discharged down the string. Furthermore, the tools also prevent wireline access through the tool to, for example, Logging While Drilling (LWD) equipment located beneath the circulation tool.

It is amongst the objectives of embodiments of the present invention to provide a circulation tool which obviates or mitigates at least one of the foregoing disadvantages.

It is a further objective of embodiments of the invention to provide a mechanism which may be used to actuate or activate a tool or device, and in particular a downhole tool or device.

SUMMARY OF THE INVENTION

According to a first aspect of the present invention, there is provided a circulating tool comprising:

a tubular body having a flow port;

first and second members mounted for movement with respect to the body, the second member closing the flow port when the member is in a first position and opening the flow port when the member is in a second position; and first and second control fluid chambers associated with the respective first and second members, movement of the first member between a first position and a second position in response to a fluid pressure force displacing control fluid from the first chamber into the second chamber, to move the second member to the second position.

The fluid pressure force may be generated by creating a pressure differential across a portion of the first member. The pressure differential may be between the interior and the exterior of the tool, in particular between fluid within the tool and fluid in the borehole annulus. Thus the first member may be moved when the pressure of the fluid in the body is a predetermined degree higher than that in the borehole annulus. Alternatively, the first member may include a flow restriction such as a nozzle and the pressure differential may occur across the nozzle.

Accordingly, an embodiment of this aspect of the invention may provide a circulating tool where a flow port may be opened to allow fluid flow to an annulus defined between the tool and a borehole of a well, by creating a pressure differential across the first member of the tool, such that the first member experiences a fluid pressure force. This fluid pressure force may move the first member and displace control fluid from the first chamber into the second chamber, to move the second member and open the flow port. Opening of the flow port allows fluid circulation in a borehole annulus to remove drill cuttings and the like. Fluid circulation is therefore achieved without discharging secondary components into the borehole.

The first member may define a differential piston, which experiences the fluid pressure force.

The second member may be adapted to be moved to the second position as a result of more than one movement of the first member. In particular, the second member may be moved to the second position following multiple, in particular four or more, movements of the first member.

Thus, multiple cycles of movement of the first member, between the first position and the second position, and thus multiple displacements of fluid from the first chamber to the second chamber, may be required to move the second member to the second position. This is particularly advantageous as the flow ports are not inadvertently opened during normal well operations where the pressure of fluid flowing within the tool may vary, for example, when fluid pumps on surface are turned on and off during the course of a drilling operation: a single pressure cycle may cycle the first member once, but this will not be sufficient to move the second member to the second position, and open the flow port.

Preferably, the first and second members are biassed towards their respective first positions. The first and second members may be biassed by springs.

Preferably, the tool further comprises a one-way valve for allowing fluid flow from the first chamber into the second chamber and for preventing return fluid flow from the second chamber into the first chamber.

The first and second members may define respective first and second pistons, the first piston for displacing fluid from the first chamber when the first member is moved between its first and second positions and the second piston being subject to a fluid pressure force for moving the second member when the control fluid is displaced into the second chamber. The first and second chambers and the first and second pistons may be annular.

The first piston may include a one way valve allowing fluid transfer within the first chamber to replace displaced fluid on one side of the piston and to allow the first member to move through the chamber and return to its first position in the chamber, typically under a restoring or biassing force. Of course the valve may be located elsewhere, if desired.

The second piston may include a bleed valve for permitting fluid flow out of the second chamber. This allows a slow bleed of fluid from the second chamber, allowing the second member to return towards its first position under a restoring or biassing force. Of course the bleed valve may be located elsewhere than the piston and in communication with the second chamber. Thus, following an initial movement of the second member towards its second position, and before the flow port is open, fluid may bleed out of the second chamber, allowing the second member to return, slowly, towards its first position. Thus, movement of the second member to its second position may require multiple cycles of the first member within a defined, and relatively short, time period. This may assist in preventing inadvertent opening of the flow port during normal well operations involving cycling the fluid pressure.

The first and second members may be sleeves mounted to an inner wall of the body. Alternatively, the first and second members may be sleeves mounted to an outer wall of the body. The second member may comprise a two-part sleeve having a first part for movement while control fluid is displaced into the second chamber, and a second part serving for opening and closing the flow port. The second part may be carried by the first part. The second member may include a flow port which is aligned with the body flow port when the second member is its second position: movement of the second member to its second position aligns the respective flow ports. The flow port of the second member may be provided in the second part thereof. The tubular member may include two or more flow ports and a corresponding number of flow ports may be provided in the second member.

The second member may be held in the second position against a biassing force on the member by a fluid pressure force produced by fluid in the tool. Thus, following movement of the second member to its second position, the body flow port may be kept open as long as the pressure of the circulating fluid is maintained above a predetermined level; when the pressure of the fluid drops, the second member may move under the biassing force to close the flow port.

The first and second chambers may be defined between the respective first and second members and the body. The tool may define a flow path for the return flow of fluid from the second chamber to the first chamber. Alternatively, fluid may be supplied to or from the first and second chambers by a separate fluid source.

A floating seal may be provided between the first member and the body for isolating the control fluid in the first chamber from fluid circulating through the tool, or from well fluid.

The tool may further comprise a plug for closing the body bore, and to direct flow through the flow port when the second member is in its second position. In the second position, the second member may engage the plug to close the body bore. In particular, the second part of the second member may engage the plug. The plug may be removable and in particular may be wireline retrievable to allow access below the circulating tool. This is of particular advantage in that it allows retrieval of LWD equipment from below the tool, in particular nuclear source logging equipment which is required to be removed if the drill string is to be abandoned in the hole if, for example, the string becomes stuck.

According to a second aspect of the present invention, there is provided a hydraulic tool assembly for a downhole tool, the assembly comprising:

a body;

first and second members mounted for independent movement with respect to the body; and first and second control fluid chambers associated with the respective first and second members, movement of the first member between a first position and a second position in response to an applied force displacing control fluid from the first chamber into the second chamber, to move the second member from a first position towards a second position to execute a tool function.

According to a third aspect of the present invention there is provided a hydraulic tool assembly comprising:

a body;

first and second members mounted for movement with respect to the body; and first and second control fluid chambers associated with the respective first and second members, movement of the first member between a first position and a second position in response to an applied force displacing control fluid from the first chamber into the second chamber, to move the second member from a first position to a second position to execute a tool function; and the second control fluid chamber having a bleed valve to allow control fluid to bleed therefrom, and the second member to return to the first position.

According to a fourth aspect of the present invention, there is provided a downhole tool comprising:

a tubular body normally open to permit fluid flow therethrough;

first and second members mounted for movement with respect to the body; and first and second control fluid chambers associated with the respective first and second members, movement of the first member between a first position and a second position in response to a fluid pressure force displacing control fluid from the first chamber into the second chamber, to move the second member to a second position, in which the second member closes the tool to prevent fluid flow therethrough.

The tool may comprise a completion test tool for testing the integrity of a completion, in particular, for pressure testing a string of tubing located in a borehole of a well, to ensure that the string is sealed, preventing fluid ingress/egress.

According to a fifth aspect of the present invention, there is provided a method of circulating fluid in a borehole annulus of a well, the method comprising the steps of:

providing a tubular body with a flow port;

mounting first and second members for movement with respect to the body;

providing first and second control fluid chambers associated with the respective first and second members;

positioning the second member in a first position where it closes the flow port;

passing circulating fluid through the tool to create a fluid pressure force on the first member to move the first member between a first position and a second position displacing control fluid from the first chamber into the second chamber and moving the second member to a second position where the flow port is open; and passing circulating fluid through the open flow port into the borehole annulus.

BRIEF DESCRIPTION OF THE DRAWINGS

Embodiments of the present invention will now be described, by way of example only, with reference to the accompanying drawings, in which.

DETAILED DESCRIPTION OF THE DRAWINGS

Figure 1:
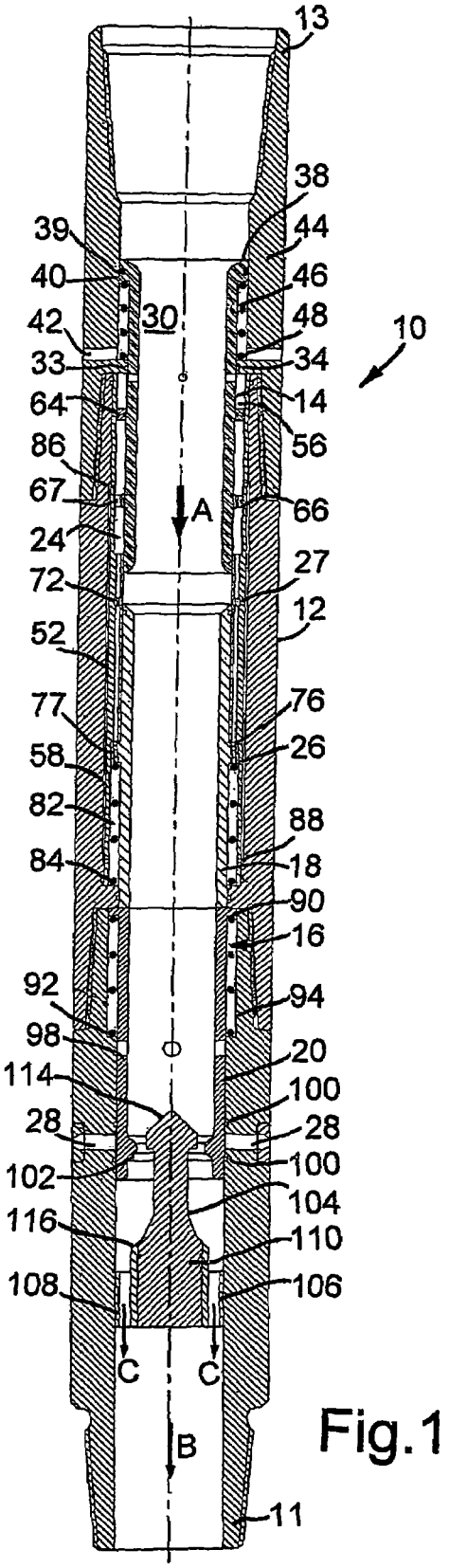
FIG. 1 is a longitudinal cross-sectional view of a preferred embodiment of a circulating tool in accordance with an embodiment of the present invention, shown in a first tool configuration where a flow port in the body of the tool is closed.
Figure 2:
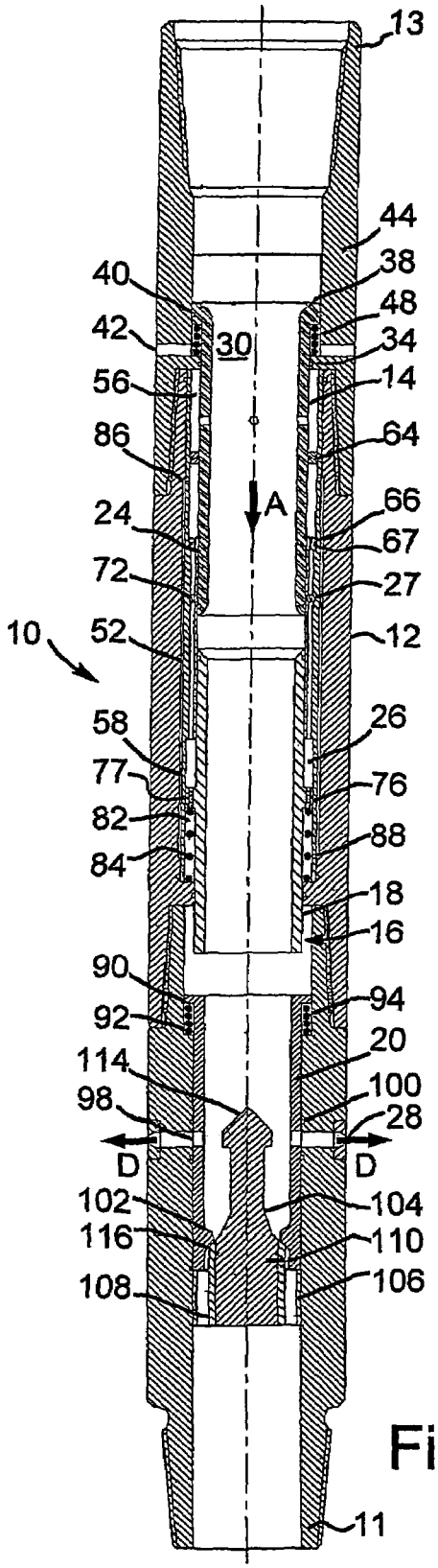
FIG. 2 is a view of the tool of FIG. 1 showing the tool in a second configuration, with the flow port open.

Referring firstly to FIGS. 1 and 2, a downhole tool in the form of a circulating tool is shown, indicated generally by reference numeral 10. The tool 10 typically forms part of a string of tubing run into a borehole of an oil or gas well in the course of a drilling operation, and is coupled to the string via threaded joints, such as API tapered threaded pin and box type joints 11, 13. Drilling fluid is pumped down through the tool 10 in the direction A to a drill bit (not shown), exiting the bit through jetting ports and returning to surface through the annulus defined between the string and the borehole wall or bore-lining casing. Whilst this flow of fluid through the annulus serves to entrain drill cuttings and carry the cuttings to surface, cuttings may settle in the bore if the flow rate of the returning fluid is not sufficiently high. Accordingly, the illustrated circulating tool 10 may be utilised to circulate fluid in the borehole annulus to facilitate removal of drill cuttings which have settled in the bore.

The circulating tool 10 comprises a tubular body 12, in which a first member in the form of an upper sleeve 14 and a second member 16 are moveably mounted. The body 12 includes a number of normally-closed flow ports 28, which may be selectively opened to allow flow of circulating fluid directly from the tool 10 into the annulus. The second member 16 comprises a two part sleeve having first and second sleeve parts 18 and 20. The upper sleeve 14, and the first and second sleeve parts 18 and 20, are biassed upwardly by respective springs 48, 84 and 94.

A first control fluid chamber 24 is provided associated with the upper sleeve 14 and a second control fluid chamber 26 is associated with the first sleeve part 18. The first and second chambers 24 and 26 are linked by a flow path 72, which includes a one-way valve 27. This valve 27 allows fluid flow in direction A, from the first chamber 24 into the second chamber 26, but prevents fluid flow in the opposite direction.

The upper sleeve 14 is movable in direction A between a first position as shown in FIG. 1 and a second position as shown in FIG. 2, in response to an applied fluid pressure force. In this example, the fluid pressure force is generated by creating a pressure differential across the upper sleeve 14. This is achieved by providing ports 42 in the body 12 to expose certain outer portions of the sleeve 14 to annulus pressure. An upper end of the sleeve 14, between seals 33 and 39, defines a differential piston area 38, such that when fluid is being pumped through the tool 10 a pressure force acts on the piston area 38.

When the pressure differential between fluid in the bore 30 and fluid in the annulus is sufficiently high, the upper sleeve 14 is moved down against the restoring or return force generated by the biassing spring 48. An annular piston 66 mounted on the sleeve 14 moves through the first chamber 24 and displaces fluid from the chamber 24 into the second chamber 26, the fluid acting on an annular piston 76 on the first sleeve part 18, to move the part 18 downwardly, carrying the second sleeve part 20 from a first position towards a second position, in which the flow ports 28 are open. With the flow ports 28 open, circulating fluid passes from the tool and string bore directly into the borehole annulus, avoiding the lower section of the string and the drill bit, and thus allowing circulation of fluid through the annulus at a higher flow rate, facilitating removal of settled drill cuttings.

It should be noted that the relative volumes of the chambers 24, 26 are such that one movement of the sleeve 14 will only displace sufficient fluid to move the sleeve parts 18, 20 only part way towards the second position. As will be described, to achieve the full movement of the parts 18, 20 typically requires at least four closely-spaced cycles of the sleeve 14.

Considering the tool 10 now in greater detail, the upper sleeve 14 is located at an upper end of the tool by shoulders 34, 35, and includes an upper lip 40 which carries the seal 39, the seal 33 being carried by the shoulder 34. The ports 42 extend through a wall 44 of the body 12, to expose a spring chamber 46 to annulus pressure. A spring 48 is located in the chamber 46, acting between the shoulder 34 and the lip 40, to urge the sleeve 14 upwardly.

As noted above, the sleeve 14 carries an annular piston 66, which is movable with the sleeve 14, and defines an upper wall of the first chamber 24. Thus, downwards movement of the sleeve. 14 causes the piston 66 to displace fluid from the first chamber 24, along the flow path 72 and through the one way valve 27, into the second chamber 26. The first sleeve part 18 carries an annular piston 76 defining a lower wall of the second chamber 26, which experiences a fluid pressure force and moves the first sleeve part 18 downwardly when control fluid is displaced into the chamber 26.

The upper piston 66 includes a one-way valve 67 which allows fluid to recharge the first chamber 24 when the differential pressure across the upper sleeve 14 is reduced and the sleeve 14 is urged upwardly relative to the body 12 by the spring 48. This will typically occur on reducing the pressure in the bore 30 by turning off the drilling fluid circulation pumps on surface.

The lower piston 76 incorporates a one-way bleed valve 77 which allows fluid to bleed from the second chamber 26. This bleed of fluid allows the first sleeve part 18 to return, slowly, to its first position under the influence of the spring 84, and prevents the flow ports 28 from being inadvertently opened when the upper sleeve 14 is moved several times over an extended period, as may typically occur during a drilling operation.

An intermediate sleeve 52 forms part of the body 12 and defines the first and second chambers 24 and 26 in combination with the upper sleeve 14 and first sleeve part 18, respectively. The intermediate sleeve 52 also defines the flow path 72 between the first and second chambers 24 and 26, and with the outer body 12 defines a further chamber 58 for return flow of control fluid from the second chamber 26 to the first chamber 24. The return flow path between the chambers 26, 24 is from the second chamber 26, into a lower spring chamber 82 (by fluid bleed through the bleed valve 77); through ports 88 in the intermediate sleeve 52 into the chamber 58; through ports 86 into an annular space 56 between the piston 66 and a floating piston 64; and through the one-way valve 67 into the first chamber 24, when the upper sleeve 14 is moving upwardly relative to the body 12.

A lower end of the first sleeve part 18 abuts the upper end of the second sleeve part 20, which part 20 defines a shoulder 90 against which the biassing spring 94 acts to urge the second part 20 upwardly. The part 20 also defines a number of flow ports 98 which, in the first position, are misaligned with the flow ports 28 in the body 12. A pair of O-ring seals 100 above and below the flow ports 28 seal the second sleeve part 20 to the body 12, isolating the flow ports 28 from the internal bore 30.

A lower end of the second sleeve part 20 is profiled to define an annular seat 102 for sealing engagement with a plug 104 when the flow ports 28 are open. The plug 104 defines a flow path 106 for the passage of drilling fluid past the plug, in the direction C, when the flow ports 28 are closed. The plug 104 is mounted on a support sleeve 108 by a shearable pin 110, and an upper end of the plug 104 defines a fishing profile 114, which allows the plug 104 to be removed to provide access to the string bore below the tool 10.

In FIG. 2, the tool 10 is shown in a configuration in which the second sleeve part 20 has been moved to its second position, to align the flow ports 98, 28. In this position, the seat 102 engages a seal face 116 of the plug 104 such that flow of drilling fluid past the plug 104 is prevented. Thus, drilling fluid passing down the string is now circulated through the flow ports 98, 28 in the direction D, exiting the tool 10 into the borehole annulus. This provides circulation in the annulus at a high flow rate to remove drill cuttings to surface.

The method of operation of the tool will now be described. The tool 10 is run in to the bore configured as illustrated in FIG. 1. Drilling fluid is pumped down through the tool bore 30 in direction A and exits the tool via the flow path 106, ultimately leaving the drill string through jetting ports in the drill bit. The spring 48 exerts a biassing force on the upper sleeve 14, acting against the fluid pressure force generated by the differential pressure across the sleeve 14. When the differential pressure is increased by turning up the drilling fluid pumps, the upper sleeve 14 is moved downwardly against the spring 48. As the upper sleeve 14 moves down, control fluid is displaced from the first chamber 24, into the second chamber 26, by the piston 66. This causes a corresponding downward movement of the piston 76, and thus downward movement of the first sleeve part 18, against the spring 84. Such downward movement of the first sleeve part 18 carries the second sleeve part 20 an increment, typically one quarter, of the distance towards the plug 104; a single movement or cycle of the upper sleeve 14 is not sufficient to align the flow ports 98 with the flow ports 28, so the flow ports 28 remain closed.

The circulation pumps are then switched off and the upper sleeve 14 is urged upwardly by the spring 48, the control fluid being prevented from flowing from the second chamber 26 back into the first chamber 24 by the one-way valve 27, and the one-way valve 67 in the piston-66 allowing the first chamber 24 to recharge with fluid. The pumps are then switched on again to increase the tool bore pressure and move the upper sleeve 14 down a second time, discharging a further volume of control fluid into the second chamber 26, and causing a corresponding incremental movement of the first and second sleeve parts 18, 20. This cycle is repeated as many times as necessary to bring the second sleeve part 20 to the second position, as shown in FIG. 2, in which the flow ports 98, 28 are aligned.

In the preferred embodiment shown, four cycles of movement of the upper sleeve 14 between its first and second positions are required to move the second sleeve part 20 a sufficient distance downwardly to align the flow ports 98, 28.

As noted above, the one way valve 77 in the piston 76 allows a slow bleed of control fluid from the second chamber 26, tending to return the first and second sleeve parts 18, 20 towards their first positions (FIG. 1), under the biassing force of the respective springs 84, 94. This fluid bleed acts to prevent the flow ports 28 from being inadvertently opened during normal well operations where the upper sleeve 14 may be moved to its second position by changes in circulating fluid flow and pressure. The bleed valve therefore acts as a safety measure to prevent inadvertent operation of the tool.

In light of the presence of the bleed valve 77, in order to align the ports 98, 28 the cycles of movement of the upper sleeve 14 must be carried out at closely-spaced intervals: if there is too great a delay between the cycles of movement of the upper sleeve 14, fluid bleed through the valve 77 allows the first sleeve part 18 to move upwardly, allowing the second sleeve part 20 to move upwardly, away from its second position in which the flow ports 28 are open.

When the flow ports 28 have been opened, the pressure of the fluid in the tool bore 30 holds the second sleeve part 20 in engagement with the plug 104, against the force of the spring 94. Thus the flow ports 28 will tend to remain open while the circulation pumps remain on, to circulate fluid to the annulus. During this time, fluid bleed through the bleed valve 77 returns the first sleeve part 18 towards its first position, and the first sleeve part 18 is shown in FIG. 2 in a position where it is travelling slowly upwardly towards its first position. When the pressure of the circulating fluid in the internal bore 30 drops, achieved by switching off the pumps, the second sleeve part 20 returns to its first position under the biassing force of the spring 94, closing the flow ports 28 in the body 12 and allowing fluid flow past the plug 104.

In other embodiments of the invention, a circulating tool may be provided which will remain open even when the flow rate or pressure of the circulating pressure is reduced. In the interest of brevity, and for ease of understanding, such a tool will be described with reference to the tool 10 as described above, and in addition with reference to FIG. 3 of the drawings, which illustrates a section of a continuous "J"-slot arrangement forming part of such a tool. The slot 120 is provided in a sleeve which is rotatable relative to the tool body 12, but fixed axially relative to the body, while the pin 130 extends radially from the second sleeve part 20, FIG. 3 illustrating seven different pin positions 130*a*–130*f*.

Figure 3:
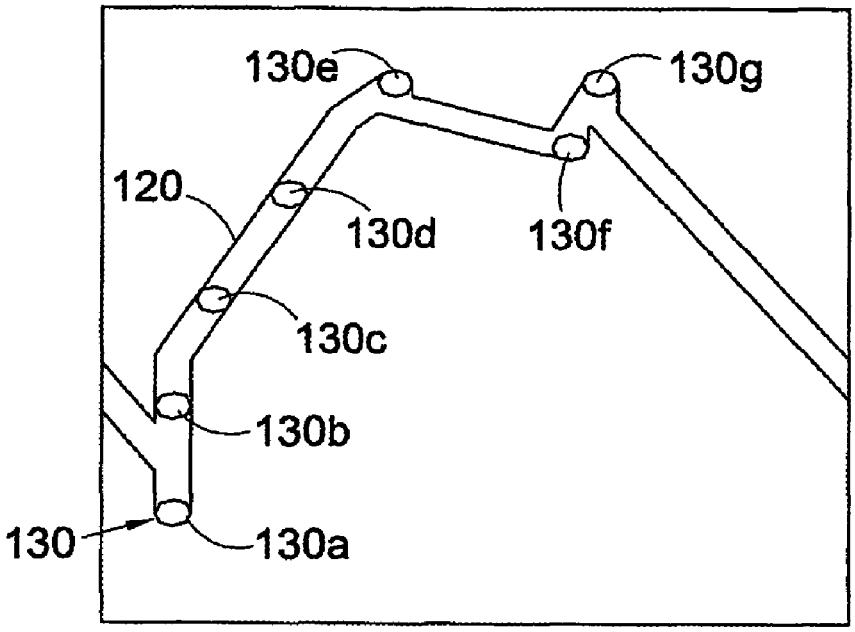
FIGS. 3 & 4 illustrate j-slot configurations of tools in accordance with further embodiments of the present invention.

The first pin position 130*a* corresponds to the tool configuration as shown in FIG. 1 (it should be noted that the slot 120 is shown inverted in FIG. 3). When the pumps are cycled for the first time the secondary pressure chamber piston 76 moves the first and second sleeve parts 18, 20 downwards by a first increment, and pushes the pin from 130*a* to 130*b*. If the pumps are cycled (that is, turned off and on) another three times in quick succession, the pin will move through positions 130*c* and 130*d* to position 130*e*; any further cycling of the pumps will not move the pin 130 further, as the piston 76 will have reached the end of its stroke.

If the pumps are not cycled again, the bleed valve 77 allows the piston 76 and the first sleeve part 18 to move back towards the first position, however the pin 130 is retained in position 130*f*, such that the second sleeve part 20 remains in the second position. The tool is thus stable in this configuration, and the ports 28, 98 remain aligned.

In order to close the ports 28, and move the pin from position 130*f*, it is necessary to cycle the pumps four times in order for the first sleeve part 18 to be moved from its first position to contact the second sleeve part 20 and push the pin 130 to position 130*g*, from where the pin 130 is free to move and allow the sleeve part 20 to move upwards relative to the body. Thus, if the pumps are not cycled again, the bleed valve 77 allows the piston 76, and with it the sleeve parts 18, 20, to return to the first position, with the pin moving back to position 130*a*.

Figure 4:
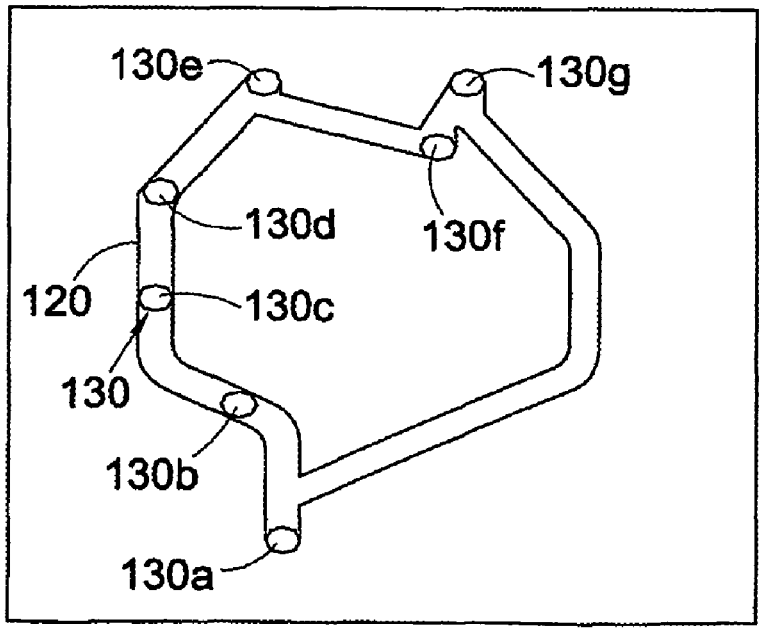

Of course the slot or cam track may take any appropriate form, and FIG. 4 of the drawings illustrates a continuous slot which requires rotation in both directions, as opposed to the single direction rotation required for the slot of FIG. 3.

One further alternative embodiment of the present invention provides a completion test valve which may be opened and closed to selectively prevent fluid flow through the valve, to allow for testing of the integrity of a string carrying the tool, for example, by carrying out a pressure test. This may be achieved by providing a tool substantially the same as the circulating tool 10 described with reference to FIGS. 1 and 2, but wherein the tool body 12 and the second sleeve part 20 do not include flow ports. When the second sleeve part is moved to its second position, the second sleeve part seals on a plug, such as the plug 104, to close the valve and prevent fluid flow therethrough. Any reduction in pressure due to fluid leakage may then be detected by a variation in the pressure of the fluid in the internal bore.

Those of skill in the art will realise that the various tools described above are merely exemplary of the present invention and that the means of operating these tools, in the form of the "hydraulic ratchet" in which control fluid displaced from a first chamber is used to move a member incrementally through a second chamber, may be used in a wide range of tools, not limited to downhole operations. However, the hydraulic ratchet offers particular advantages in downhole operations and provides a mechanism that allows normal drilling or completion activities to be conducted as required prior to performing a specific task, such as opening a valve, as described above. Further the hydraulic ratchet is capable of resetting to an original configuration, if required, to allow many periods of normal activity interspersed with periods in which a tool or device is activated or operated to perform or provide specific tasks. The mechanism will normally reset to an original configuration in a predetermined period of time and then, if cycled a number of times in quick succession, may again serve to perform the specified task, such as to cause actuation of an axial or rotary switch or device before resetting to the original configuration again, if desired. Alternatively, when utilised in combination with a cam arrangement, such as described above, the mechanism may be arranged to be stable in two or more positions or configurations, and only reset when desired.

Those of skill in the art will recognise that the hydraulic ratchet mechanism may be used to remotely perform many tasks in a more efficient and controlled manner than is currently available. Some examples of appropriate applications are set out below.

As noted above, the mechanism may be utilised to actuate a circulating valve. The valve may be actuated on demand and then resealed, and is thus a multi-cycle system, in that the valve may be actuated and resealed on as many occasions as is necessary.

The mechanism may be utilised as a general pilot mechanism to unlock/release a drilling or completion device. This may be achieved by rotary or axial movement unlocking a latched device or triggering a switch.

In another embodiment the mechanism may be utilised to activate an under-reaming tool after drilling out or passing a shoe. This may be achieved by rotary or axial movement unlocking a latched device.

The mechanism is suited to use in setting a packer, and the hydraulic ratchet may be provided as an integral part of a retrievable packer or as a permanent packer setting tool. The invention would also be suitable for use in a resettable packer, as the mechanism would permit a packer to be set, released and then reset, on as many occasions as desired.

In further embodiments, the mechanism may be utilised to set a liner hanger, a bridge plug, or a tubing anchor.

The mechanism may also be employed to trigger perforating guns by axial or rotary movement onto a switch. The mechanism would allow normal operations to continue until a series of pump cycles were performed in quick succession.

The hydraulic ratchet may be utilised to open/close a completion isolation ball valve (CIV). The CIV can be used for a variety of purposes including fluid loss control and underbalanced completion installation. The valve would be opened and closed on demand using the hydraulic ratchet. The valve may be used to conduct an unlimited number of pressure tests in either direction.

The ratchet may be employed in other forms of valve, for example to open/close a general tubing ball or flapper valve, or to open/close a completion sliding door to obtain communication between bore and annulus. In this latter embodiment, the hydraulic ratchet allows communication to be opened and closed on demand without the need for wireline intervention.

As noted above, the hydraulic ratchet may be used in conjunction with a continuous or closed J-Slot type device, and such embodiments of the invention may be utilised to allow a hydraulically or weight set drilling or completion tool (such as an adjustable stabiliser) to be used in a default position for normal operations, but where repeated quick succession pump cycles would cause a collet and latch mechanism to engage preventing the tool from moving to the default position, that is locking the tool in a secondary position.

The invention claimed is:

1. A hydraulic tool assembly for a downhole tool, the assembly comprising:

a body;

first and second members mounted for independent movement with respect to the body; and first and second control fluid chambers associated with the respective first and second members, movement of the first member between a first position and a second position in response to an applied force displacing control fluid from the first chamber into the second chamber, to move the second member from a first position towards a second position to execute a tool function, the second control fluid chamber having a bleed valve for permitting control fluid to bleed therefrom, and the second member to return to the first position, and wherein the assembly is configured such that movement of the second member from the first position to the second position requires more than one movement cycle of the first member between its respective first position and second position.

2. The assembly of claim 1, wherein at least four movements of the first member from its first position to its second position are required to move the second member from its first position to its second position.

3. The assembly of claim 1, wherein the first member is biased towards its first position.

4. The assembly of claim 1, wherein the second member is biased towards its first position.

5. The assembly of claim 1, wherein the first member is adapted to be moveable in response to a fluid pressure force.

6. The assembly of claim 5, wherein the first member is configured to permit creation of a pressure differential across a portion thereof.

7. The assembly of claim 6, wherein the first member defines a differential piston having one face in communication with the interior of the tool and another face in communication with the exterior of the tool.

8. The assembly of claim 1, comprising a fluid conduit between the first and second chambers, the conduit including a one-way valve for allowing fluid flow from the first chamber into the second chamber and for preventing return fluid flow from the second chamber into the first chamber.

9. The assembly of claim 1, wherein the first member comprises a piston for displacing fluid from the first chamber when the first member is moved between its first and second positions.

10. The assembly of claim 9, wherein the first member piston includes a one-way valve for permitting fluid transfer within the first chamber to replace fluid displaced from one side of the piston and to allow the first member to move through the chamber and return to its second position to its first position.

11. The assembly of claim 1, wherein the second member comprises a piston adapted to experience a fluid pressure force for moving the second member from its first position to its second position when the control fluid is displaced into the second chamber.

12. The assembly of claim 11, wherein the second piston includes a bleed valve for permitting control fluid to bleed from the second chamber, and the second member to return to its first position.

13. The assembly of claim 1, wherein the first member is a sleeve.

14. The assembly of claim 1, wherein the second member is a sleeve.

15. The assembly of claim 1, wherein the second member comprises at least two parts, which parts may be axially separated.

16. The assembly of claim 1, comprising a fluid conduit for the return flow of fluid from the second chamber to the first chamber.

17. The assembly of claim 1, wherein the first chamber comprises a floating seal for isolating control fluid in the first chamber from fluid circulating through the assembly.

18. The assembly of claim 1, comprising means for controlling movement of the second member relative to the body.

19. The assembly of claim 18, wherein the means for controlling movement of the second member is a cam arrangement.

20. The assembly of claim 19, wherein the cam arrangement comprises a slot defined by one of the second member and the body and a follower coupled to the other of the second member and the body.

21. The assembly of claim 18, wherein the means for controlling movement of the second member relative to the body is configured to permit the second member to be selectively retained in the second position.

22. The assembly of claim 18, wherein the means for controlling movement of the second member relative to the body comprises a continuous j-slot.

23. The assembly of claim 1, in combination with an under-reaming tool.

24. The assembly of claim 1, in combination with one of a circulating valve, an under-reaming tool, a setting tool, a downhole packer, a liner hanger, a bridge plug, a tubing anchor, a perforating gun, a completion isolation ball valve, a ball valve, a flapper valve, a completion sliding door, and an adjustable stabilizer.

25. A circulating tool comprising:

a tubular body having a flow port;

first and second members mounted for movement with respect to the body, the second member closing the flow port when the second member is in a first position and opening the flow port when the second member is in a second position; and first and second control fluid chambers associated with the respective first and second members, more than one movement cycle of the first member between a first position and a second position, in response to a fluid pressure force, being required to displace control fluid from the first chamber into the second chamber, in order to move the second member to the second position.

* * * * *